United States Patent [19]

Howatt

[11] 4,106,431

[45] Aug. 15, 1978

[54] GUM APPLICATOR

[75] Inventor: George Frederick Howatt, Holden, Mass.

[73] Assignee: New England Envelope Manufacturing, Worcester, Mass.

[21] Appl. No.: 763,574

[22] Filed: Jan. 28, 1977

[51] Int. Cl.[2] ..... B05C 1/02

[52] U.S. Cl. ..... 118/203; 118/212; 118/262

[58] Field of Search ..... 118/212, 262, 203; 101/351, 425

[56] References Cited

U.S. PATENT DOCUMENTS

| | | | |
|---|---|---|---|
| 2,644,424 | 7/1953 | Bixby | 118/262 X |
| 2,731,945 | 1/1956 | Schaefer | 118/262 X |
| 2,875,726 | 3/1959 | Anness | 118/212 |
| 3,013,527 | 12/1961 | Novick | 118/212 X |
| 3,023,128 | 2/1962 | Affelder | 118/212 X |
| 3,712,185 | 1/1973 | Falasconi et al. | 118/212 X |
| 3,973,516 | 8/1976 | Minkow | 118/262 |

*Primary Examiner*—John P. McIntosh

*Attorney, Agent, or Firm*—Norman S. Blodgett; Gerry A. Blodgett

[57] ABSTRACT

Gum applicator having a primary roller whose lower periphery extends into the box for emersion in a body of gum and a secondary roller which contacts the primary roller at a point well about the point where it emerges from the body of gum and which has a reduced central portion of substantial length.

8 Claims, 5 Drawing Figures

GUM APPLICATOR

BACKGROUND OF THE INVENTION

In the design of machines for the manufacture of envelopes and the like, it is common practice to apply the glue, adhesive, or gum by an "offset" process in a manner similar to printing. The offset apparatus receives the glue from a roller with which it comes in contact and it then transfers the gum onto the envelope blank. It will be readily appreciated that, in order that the apparatus may operate properly, the gum must be spread very evenly on the transfer roller and without defects in the gum. The layer of gum has been applied in the past by using a primary roller whose periphery resides in a body of gum and which contacts the transfer roller while rotating in the same direction, so that the gum resides in a pool in the nip between the two rollers. The thickness of the layer of gum which is lifted from the gum box by the primary roller and carried over to the transfer roller is regulated by a doctor blade or roller whose operative edge is fixed in spaced relationship to the surface of the primary roller, so that only the desired amount of gum passes through this gap and the excess is scraped back into the gum box. There are a number of problems associated with this arrangement, one of them being that a change in viscosity of the gum can cause large changes in the thickness of the coat. Of course, too much gum is wasteful of the expensive gum. Too thin a coat results in an inoperative envelope and in customer complaints, if the defective envelope should pass through the inspector's observing eyes. The old arrangements also result in excessive churning of the gum, which means that the gum is mixed with oxygen and, therefore, oxidizes and thickens. More bubbles of hardened glue are passed on to the envelope as well as hardened particles that may accumulate on the blade before eventually being released and passed on to the transfer mechanism. Furthermore, the churning causes a hardening of the glue on the edge of the doctor blade that results in localized streaking and results in an envelope whose appearance is less than desirable and whose elements are not properly cemented together. These and other difficulties experienced with the prior art devices have been obviated in a novel manner by the present invention.

A gum applicator capable of providing a transfer roller with an even layer of gum which is free of particles or streaks.

It is, therefore, an outstanding object of the invention to provide a gum applicator for use with an envelope machine, in which the gum is subjected to very little mechanical agitation.

Another object of this invention is the provision of a gum box in which circulation of gum takes place from the ends toward the middle and back again to produce an even distribution of gum across a primary roller and to keep that gum thoroughly mixed and at a constant viscosity.

A further object of the present invention is the provision of a gum box which can be retro-fitted to existing envelope-making machines without substantial alteration of the machine.

It is another object of the instant invention to provide a gum box in which the operative elements can be readily cleaned without complete disassembly thereof or removel from the envelope machine.

A still further object of the invention is the provision of a gum box which is simple in construction, which is inexpensive to manufacture, and which is capable of a long life of useful service with a minimum of maintenance.

A further object of this invention is to provide a small secondary reservoir with a fresh gum supply from which the transfer roll (which runs at the relatively high machine surface speeds) can draw its needs with a minimum of agitation to the entire adhesive supply.

SUMMARY OF THE INVENTION

In general, the invention leads to a gum applicator for use in an envelope manufacturing machine or the like, including an elongated box with an open top adapted to contain a body of liquid gum. It includes a primary roller mounted for rotation about a first axis extending longitudinally of the box with its lower periphery lying in the box and submerged in the body of gum. A secondary roller is mounted for rotation about a second axis parallel to and spaced from the first axis, the secondary roller being biased toward the primary roller for contact with its surface as it emerges from the body of gum.

More specifically, the secondary roller is rotatably mounted in a carrier element which in turn is swingable above a third axis which is spaced from and is parallel to the first and second axis. The third axis is located above the primary roller, so that the secondary roller is biased by gravity toward contact with the primary roller. The secondary roller is provided with an extensive central portion of reduced diameter.

DESCRIPTION OF THE PREFERRED EMBODIMENT

Figure 1:
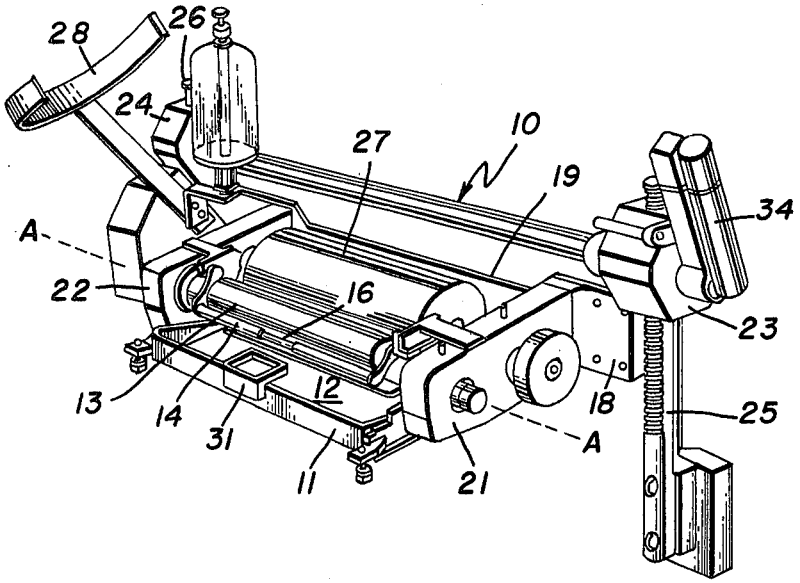
FIG. 1 is a prospective view of a gum applicator embodying the principals of the present invention.

Referring first to FIG. 1, wherein are best shown the general features of the invention, the gum applicator, indicated generally by the reference number 10, is shown as have an elongated box 11 with an open top adapted to contain a body 12 of gum. A primary roller 13 is mounted for rotation above a first axis A—A which extends longitudinally of the box, the roller having its lower periphery lying in the box and submerged in the body 12 of gum. A secondary roller 14 is mounted for rotation above a second axis B—B (See FIG. 3) which is parallel to and spaced from the first axis A—A. The secondary roller 14 is biased toward the primary roller 13 for contact with its outer cylindrical surface at a portion thereof just above the point where the surface of the roller emerges from the body of gum.

The secondary roller 14 is rotatably mounted in a carrier element 15 which in turn is swingable about a third axis C—C which is spaced from and parallel to the first and second axis. The third axis is located above the primary roller 13, so that the secondary roller 14 is biased by gravity toward contact with the primary roller at the portion mentioned above.

Figure 2:
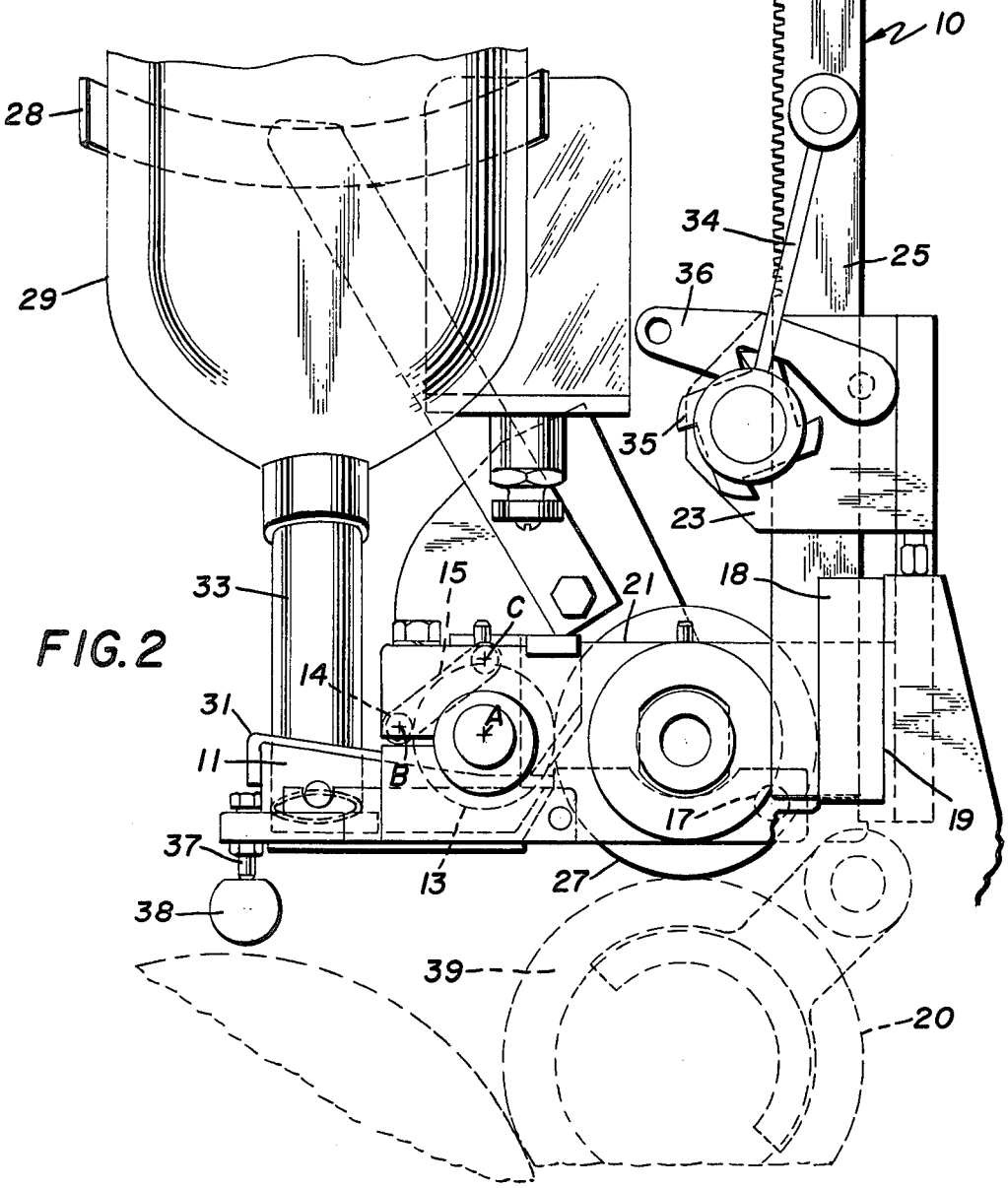
FIG. 2 is an end elevational view of the applicator as viewed from the operator's side of an envelope-making machine or which it is mounted.
Figure 3:
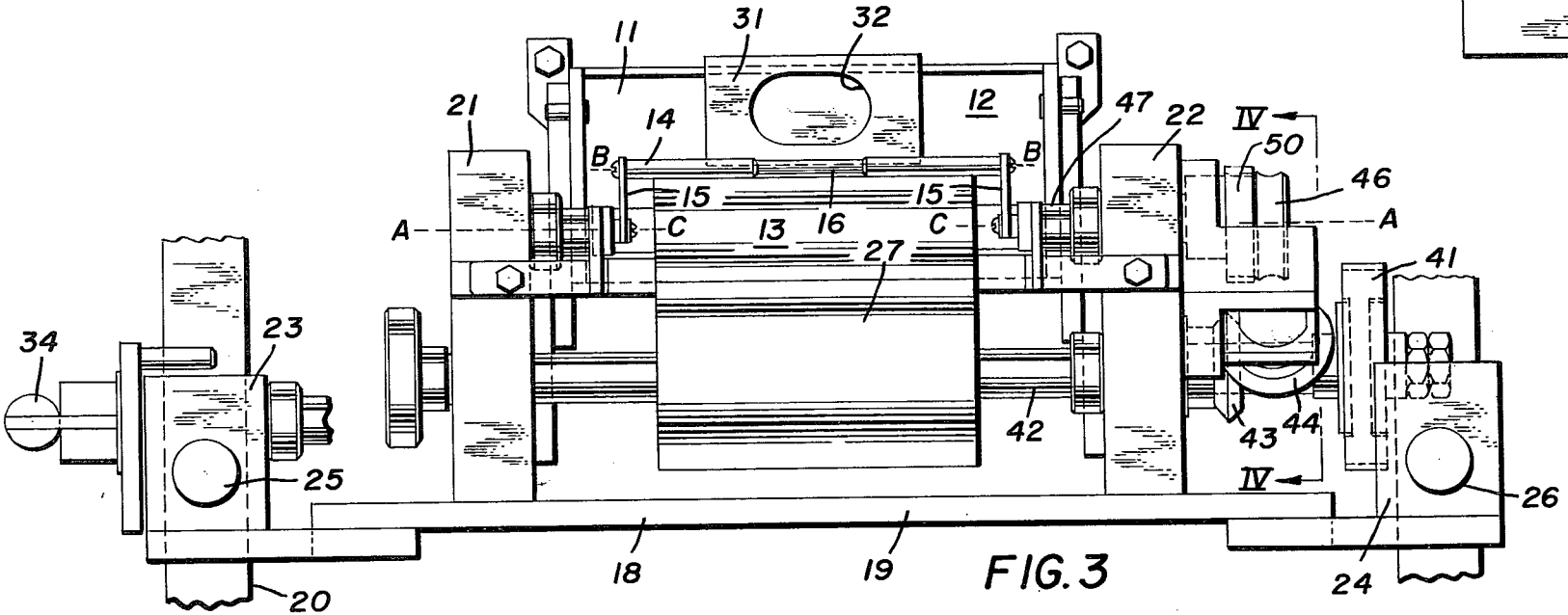
FIG. 3 is a plan view of the applicator.

FIGS. 2, 3, 4, & 5 show the details of construction of the applicator. In FIG. 3 it is particulary evident that the secondary roller 14 is provided with a central portion 16 of reduced diameter. This portion extends for approximately one-third of the length of the roller 14 and extends substantially more than one-third of the length of the primary roller 13. The gum box 11 is mounted for hinged movement on hinge pins 17 (FIG. 2), so that, when the rollers are lifted, the box falls downwardly and exposes the entire surfaces of the rollers 13 and 14 for cleaning. The apparatus is provided with a frame 18 having a cross member 19 adapted to lie transversely of an envelope-making machine 20 of the type shown and described in the patent of Howatt No. 3,982,472 which issued on Sept. 28, 1976. Extending from the cross member are two spaced, parallel, side members 21 and 22 that extend from the ends of the cross member longitudinally of the envelope-making machine. Blocks 23 and 24, each provided with a vertical bore, are attached to the ends of the cross member 19 and a pair of vertical posts 25 and 26 are carried in the block bores and are adapted to be fastened to the machine 20 on either side thereof.

As is best evident in FIG. 3, the carrier elements 15 for the secondary roller 14 are pivotally mounted on the side members 21 and 22, while the pivot pins 17 for the box 11 are also carried in the side members. The primary roller 13 is rotatably carried in the side members and a large transfer roller 27 is rotatably mounted in the side members exteriorly of the box, but with its peripheral surface engaging the surface of the primary roller 13 at the side thereof opposite the side contacted by the secondary roller 14. A rack 28 is mounted on the side member 22 for holding a gum supply bottle 29 and a locating frame 31 with an aperture 32 is mounted on the box 11, the aperture serving to locate the nozzle of the supply bottle 29.

The vertical post 25 is provided with teeth (See FIG. 2) and the block 23 is provided with an internal gear (not shown) which engages the teeth and is rotated from the outside by a crank handle 34. The crank handle is provided with a ratchet 35 which is engaged by a locking pawl 36.

In FIG. 2 it can be seen that the portion of the gum box 11 which is furthest away from its pivot pin 17 is provided at its corners with adjustable stop bolts 37 which rests on a cross beam 38 that is part of the envelope making machine 20. The same view shows that the transfer roller 27 contacts a picker roll 39 which is part of the machine 20 and which serves to transfer a pattern of glue to envelope blanks or the like.

Figure 4:
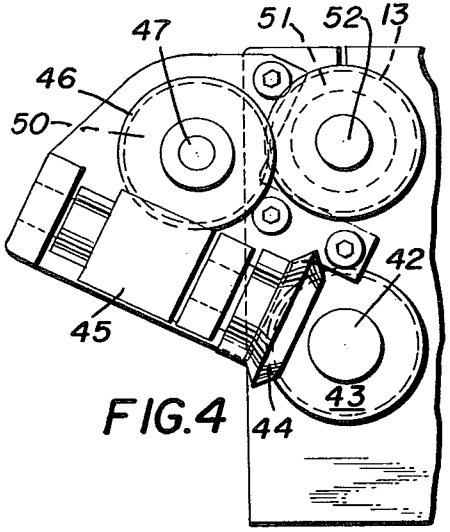
FIG. 4 is vertical sectional view of a portion of the applicator taken on the line IV—IV of FIG. 3.
Figure 5:
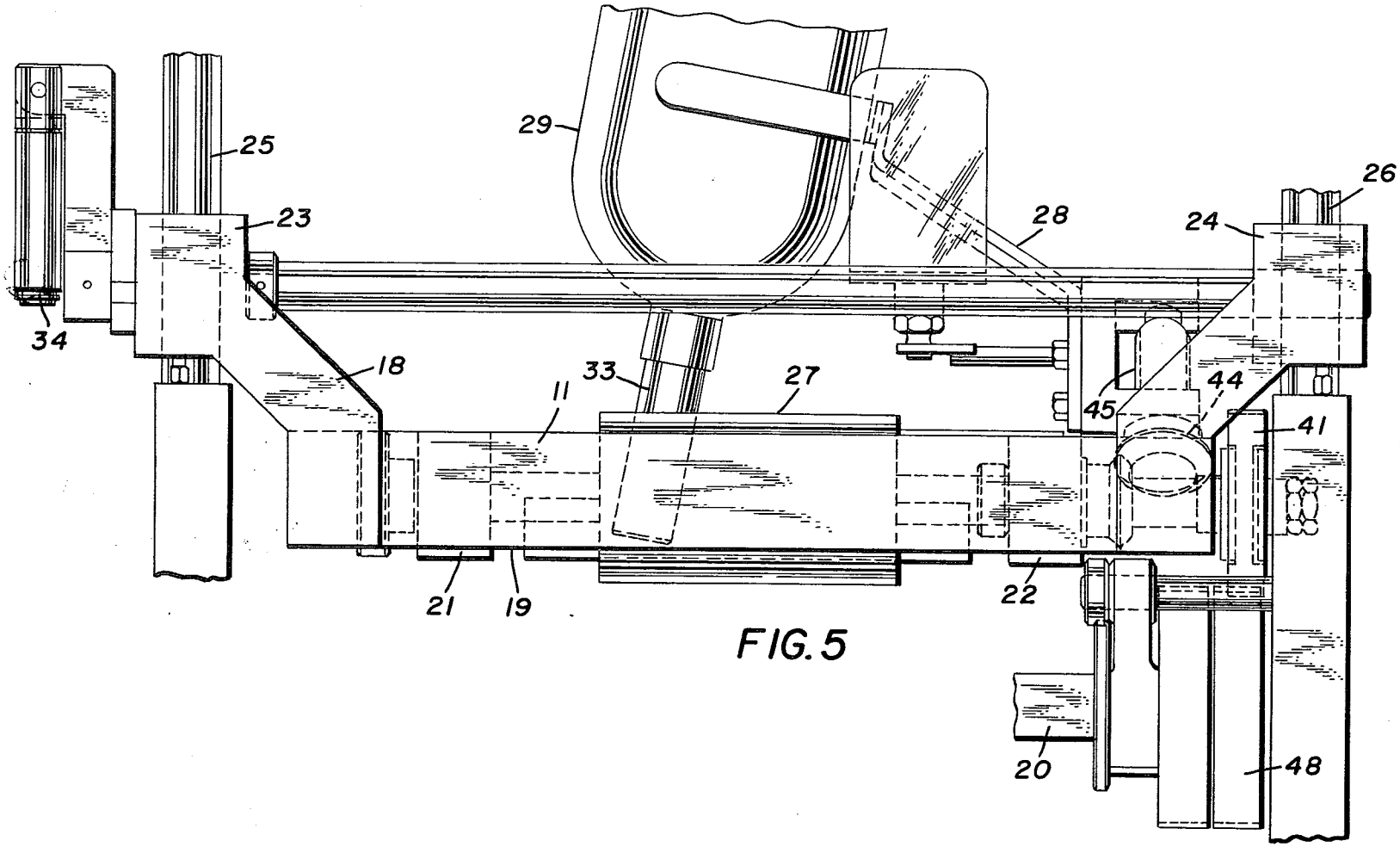
FIG. 5 is a front elevational view of the applicator as observed from the discharge and of the envelope-making machine.

FIGS. 3 and 4 show the manner in which the primary roller 13 and the transfer roller 27 are driven from the interior of the envelope-making machine 20. A spur gear 41 is mounted on the shaft 42 of the transfer roller 27 which also carries a bevel gear 43 which in turn engages and drives a bevel gear 44 rotatably mounted on a shaft, the intermediate portion of which carries a worm 45 which engages a worm gear 46. The gear 46 is mounted as an idler on the outer end of the shaft 47. A spur gear 50 on shaft 47 drives a gear 51 on a shaft 52 which carries the primary roller 13. In FIG. 5 it can be seen that the gear 41 engages and is driven by a spur gear 48 forming part of the machine 20.

The operation and advantages of the gum applicator of the invention will now be readily understood in view of the above description. With the applicator mounted on the envelope-making machine 20 and the gum box 11 carrying a body 12 of gum, the machine is set in operation. The gear 48 serves through intermediate gearing to drive the primary roller 13 and the transfer roller 27 at predetermined low speeds. The secondary roller 14 is an idler roller and may rotate in its carrier elements 15 in accordance with contact with a layer of gum on the primary roller 13. The automatic nozzle 33, forming part of the gum bottle 29, maintains the body 12 of gum in the box 11 at a predetermined, constant level. The roller 13 rotates clockwise (as observed from the right hand side and shown in FIG. 2) and picks up gum from the body 12. It carries the gum upwardly in a clockwise direction until it arrives at the contact nip between the primary roller 13 and the transfer roller 27. The gum will form a small secondary reservoir in the nip between the primary roller 13 and the transfer roller 27. The transfer roller rotates counter-clockwise and carries a layer of gum on its surface which is transferred to the picker roller 39 at an appropriate time. Normally, the picker roller will have a shaped pad which picks up the gum and "prints" it on the envelope surface. Referring particularly to FIG. 3, the fact that the recess or reduced central portion 16 of the secondary roller 14 exists causes a flow of gum upwardly at the center of the primary roll 13 and secondary roll 14 into the small reservoir at the bight of rolls 13 & 27 and flows outwardly and downwardly at the ends of the rollers 13 and 27 toward the body of gum 12 in the box 11. The flow takes place, therefore, from the ends of the box 11 toward the center and any small particles of gum which would otherwise be caught between the secondary roller 14 and the primary roller 13 are carried into the central portion and either returned to the body of gum or moved up on the roller. Furthermore, because the secondary roller 14 is pivoted about the axis C—C, it rests under the action of gravity against a film of gum lying on the surface of the primary roller. When the gum becomes more viscous, due to change in temperature or evaporation, the roller rises and allows the gum to flow more freely through the gap between the secondary roller 14 and the primary roller 13. This tends to keep the layer of gum at a more or less constant value, irrespective of changes of temperature and of evaporation in the box. In the prior art doctor blade apparatus, the presence of the particles of hardened gum in the gap caused streaks in the layer of gum on the primary roller 13 and these streaks were transferred to the transfer roller 27 and eventually to the envelope. Often such particles would agglomerate with other particles and form a large particle until the force became so great that the large particle of gum was suddenly released and was applied to the envelope surface, where it causes trouble later on in the envelope-making machine. With the present invention, a small particle can pass under the secondary roller 14 which simply rises over it and it is allowed to pass into the machine or is crushed between the rollers 13 and 27 before it accumulates to a size that could be a problem. The movement of the glue toward the center and outwardly into the gum box again causes a circulation which thoroughly mixes the gum and does not allow variation in its viscosity and texture. This movement also washes troublesome particles into the center portion where they don't cause a problem. Occasionally, the rollers should be cleaned and, for that purpose, it is a simple matter of unfolding the handle 34 and rotating it. This causes the frame to slide upwardly along the fixed posts 25 and 26 to a high position. The frame rises, the gum box 11 pivots above its pivot pins 17, leaving its outer ends at the low position supported on the cross beam 38 of the machine. Eventually, the rollers 13, 14, and 27 are clear of the gum box 11 and the gum, so that they can be readily cleaned. As a matter of fact, the gum box itself in this inclined condition can also be easily cleaned since it is separated from the rollers with its interior readily accessible and can be easily lifted out for cleaning.

It can be seen, then, that the apparatus provides a second small reservoir with a fresh gum supply from which the transfer roll obtains its supply of gum. This is done with a minimum of agitation to the entire system, especially at high speeds. In a commercial embodiment of the invention, the agitation is reduced at least 90%. The apparatus provides a circulating-system to maintain viscosity by mixing fresh gum with used gum without cumbersome and expensive auxiliary equipment.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Gum applicator, comprising:

(a) an elongated box with an open top adapted to contain a body of gum, (b) a primary roller mounted for rotation about a first axis extending longitudinally of the box with its lower periphery lying in the box and submerged in the body, (c) a secondary roller mounted for rotation about a second axis parallel to and spaced from the first axis, the secondary roller being biased toward the primary roller for contact with its surface at a portion hereof as it emerges from the body of gum, and rotatably mounted in a carrier element which in turn is swingable about a third axis spaced from and parallel to the first and second axis, the third axis being located above the primary roller, so that the secondary roller is biased by gravity toward contact with the primary roller, said secondary roller being provided with a central portion of reduced diameter, the length of said central portion being substantially less than the total length of the portions of said secondary roller which contact said primary roller, and (d) a transfer roller contacting the primary roller to form a small secondary reservoir in the nip between the rollers.

2. Gum applicator as recited in claim 1, wherein the box is mounted for hinged movement on pivot pins, so that, when the rollers are lifted, the box falls downwardly and exposes the entire surfaces of the rolls for cleaning.

3. Gum applicator as recited in claim 1, wherein a rack is mounted on a side member for holding a gum supply bottle, and wherein a locating frame is centrally mounted on the box and has an aperture in which a nozzle of the supply bottle is placed.

4. Gum applicator as recited in claim 1, wherein an applicator roll is provided with rotating means to provide a surface speed approximately that of the envelope-making machine, the primary roller having a substantially lower surface speed than the transfer roller, so that the primary roller acts both as a supply roll to a secondary reservoir and a metering roll to the applicator roller.

5. A gum applicator as recited in claim 1, wherein the said secondary reservoir continually receives a fresh gum supply from the primary roller, so that only a limited amount of the total gum supply is subjected to agitation by the transfer roller, and wherein the surface movement of each roller at said secondary reservoir is in a downward direction.

6. Gum applicator, comprising:

(a) a frame having a cross member adapted to lie transversely of an envelope-making machine and having two-spaced, parallel side members extending longitudinally of the machine from the ends of the cross member, wherein a block with a vertical bore is attached at each end of the cross member and wherein a pair of vertical posts are carried in the block bores and adapted to be fastened to the machine on either side thereof, (b) an elongated box mounted for hinged movement on pivot pins carried in the side members of said frame, so that when the frame is lifted, the box falls downwardly and exposes the entire surfaces of rolls for cleaning, said box having an open top and adapted to contain a body of gum, (c) a primary roller mounted for rotation on said side members about a first axis extending longitudinally of the box with its lower periphery lying in the box and submerged in the body of gum, (d) a secondary roller mounted for rotation about a second axis parallel to and spaced from said first axis, the secondary roller being biased toward the primary roller for contact with its surface at a portion thereof as it emerges from the body of gum, said secondary roller being rotatably mounted in a carrier element which in turn is swingably mounted on the side members of said frame around a third axis spaced from and parallel to the first and second axes, the third axis being located above the primary roller, so that the secondary roller is biased by gravity toward contact with the primary roller, said secondary roller being provided with a central portion of reduced diameter, and (e) a transfer roller rotatably mounted in the side members exteriorly of the box, but with its peripheral surface engaging the surface of the primary roller at the side thereof opposite the side contacted by the secondary roller for forming a small secondary reservoir in the nip between the rollers.

7. Gum applicator as recited in claim 6, wherein one of the vertical posts is provided with teeth and the corresponding block is provided with a gear for engagement with the teeth for raising the frame on occasion.

8. Gum applicator for use on an envelope-making machine, comprising:

(a) an elongated box with an open top adapted to contain a body of gum, (b) a primary roller mounted for rotation about an axis extending longitudinally of the box with its lower periphery lying in the box and submerged in the body of gum, and (c) a frame mounted for vertical movement on the machine and on which the primary roller is mounted, the box being also mounted on the frame for hinged movement on pivot pins, so that, when the frame and the roller are subjected to the vertical movement, the box falls downwardly to expose the entire surface of the roller for cleaning, the pivot pins defining an axis passing through one extremity of the box, while the other extremity of the box remains in contact with the machine.

* * * * *